US006894209B2

(12) United States Patent
Holler

(10) Patent No.: US 6,894,209 B2
(45) Date of Patent: May 17, 2005

(54) GUITAR HAVING A PARTIALLY SLOPED SOUNDING BOARD

(76) Inventor: James M. Holler, 2089 Camp St., Jamestown, NY (US) 14701

( * ) Notice: Subject to any disclaimer, the term of this patent is extended or adjusted under 35 U.S.C. 154(b) by 98 days.

(21) Appl. No.: 10/639,115

(22) Filed: Aug. 12, 2003

(65) Prior Publication Data

US 2004/0031371 A1 Feb. 19, 2004

Related U.S. Application Data

(60) Provisional application No. 60/402,852, filed on Aug. 12, 2002.

(51) Int. Cl.[7] ..... G10D 3/00

(52) U.S. Cl. ..... 84/291; 84/293; 84/294; 84/270; 84/267

(58) Field of Search ..... 84/291, 293, 294, 84/270, 267

(56) References Cited

U.S. PATENT DOCUMENTS

| | | | | | |
|---|---|---|---|---|---|
| 4,320,685 | A | | 3/1982 | Pytlewski | 84/291 |
| 4,411,186 | A | * | 10/1983 | Faivre | 84/291 |
| 4,856,403 | A | * | 8/1989 | Davies | 84/291 |
| 4,873,909 | A | | 10/1989 | Humphrey | 84/293 |
| 5,025,695 | A | | 6/1991 | Viel | 84/293 |
| 6,034,308 | A | * | 3/2000 | Little | 84/291 |
| 6,034,310 | A | | 3/2000 | Kolano | 84/293 |
| 6,051,765 | A | | 4/2000 | Regenberg et al. | 84/293 |
| 6,294,718 | B1 | | 9/2001 | Saunders, Jr. et al. | 84/291 |
| 6,372,970 | B1 | | 4/2002 | Saunders, Jr. et al. | 84/293 |
| 2002/0100357 | A1 | | 8/2002 | Saunders, Jr. et al. | 84/291 |

* cited by examiner

*Primary Examiner*—Shih-yung Hsieh
(74) *Attorney, Agent, or Firm*—Barlow, Josephs & Holmes, Ltd.

(57) ABSTRACT

A guitar configuration that has improved playability without requiring a raised fret or fingerboards or a neck that extends through the resonance chamber all the way to the sound hole is disclosed. The particular construction of the present invention includes a soundboard with a partially curved portion that provides additional clearance for the guitarist's hand thereby allowing the guitarist to play the higher fret positions without changing the position of the fretting hand. The tapered construction of the soundboard is achieved while maintaining the structural integrity of the guitar construction while eliminating the need for extending the neck of the guitar through the sound chamber up to the sound hole in the sounding board.

15 Claims, 9 Drawing Sheets

GUITAR HAVING A PARTIALLY SLOPED SOUNDING BOARD

CROSS-REFERENCE TO RELATED APPLICATIONS

This application is related to and claims priority from earlier filed U.S. Provisional Patent Application No. 60/402,852, filed Aug. 12, 2002, the entire contents thereof are incorporated herein by reference.

BACKGROUND OF THE INVENTION

The present invention relates generally to stringed instruments. More particularly the present invention relates to a guitar wherein the sounding board is partially bent inwardly on one side adjacent the fingerboard thereof to provide additional space for the person playing the guitar to access the higher frets.

In the field of guitar manufacturing and designing it is a continuing objective to produce a guitar that has improved tonal qualities, while configuring the guitar in a manner that makes it easier for the guitarist to play. A significant drawback found in the general configuration of most prior art guitars is the area where the neck portion and the body portion of the guitar are connected. Traditionally, the neck and body of the guitar must be rigidly connected to provide stability and consistency for the tensioning of the strings. The fingerboard that runs along and is affixed to the upper surface of the neck is substantially is arranged to be parallel with and in close proximity to the upper surface of the body of the guitar, known as the soundboard. The fingerboard includes a number of raised lateral bars, known as frets, over which the strings pass. The frets generally are known by their number, i.e. twelfth fret, with the numbers beginning at the distal end of the fingerboard and increasing as they approach the soundboard.

When playing the guitar, the guitarist presses the desired string against one of the frets thereby controlling the length of the string allowed to vibrate when struck resulting in the desired note. This configuration requires that the guitarist have very flexible hands and fingers to reach the correct positions along the fingerboard of the guitar. To further complicate the playing of the guitar, all the highest numbered frets beginning above the body to neck junction are located on the portion of the fingerboard, which rests on the soundboard and is parallel and in close proximity therewith. As a result, on known guitars, the guitarist's hand makes contact with the body portion of the guitar starting around the ninth or tenth position. Above that position, a player is then forced to change the fretting hand position. Further up the neck, above the eleventh position, the fretting hand and the arm must change position. In order to play notes in these higher fret positions, the guitarist must shift his entire arm by elevating it and leaning his body forward to reach around the neck of the guitar thereby gaining a new position above the soundboard of the instrument. After completing this maneuver, the player's fingers must then be forced down with tremendous pressure in order to cause the strings to make contact with the highest frets.

There are several examples of guitar constructions that attempt to aid in the playability of the guitar when playing higher fret positions. One type of construction is illustrated by Mr. Gregory Byers in *American Lutherie*, No. 64, Winter 2000. The Byers guitar generally includes a neck that is elevated relative to the body. The body has a top soundboard that includes a sound hole, a sloped portion that slopes in an upward, inclined direction away from the sound hole and towards the neck, and a neck receiving slot extending through the sloped portion of the soundboard all the way to the sound hole. According to Mr. Byers, this design improves playability of the twelfth fret.

Another example of this type of modified construction is found in U.S. Pat. No. 4,873,909, issued to Humphrey. As compared to the design noted above, the guitar in the Humphrey patent is disclosed as having a soundboard that includes a sloped portion that slopes in a declined (as opposed to inclined) direction away from the sound hole and towards the neck. Also, the neck sits on a neck base, as opposed to being received in a neck receiving slot. The fingerboard is configured to continue over the soundboard in the plane of the top surface of the neck and is thereby elevated from the surface of the soundboard.

As can be seen each of the preceding examples includes a fret or fingerboard that is raised relative to the surface of the soundboard and the entire surface of the soundboards are sloped relative to the bottom wall of the guitar rather than parallel. To facilitate this particular configuration and maintain the quality of the guitar construction, the necks of the guitar extend all the way to the edge of the sound hole. In this manner, these guitars are intended to ease playability above the twelfth fret. However, the resonance chamber in both of these cases is significantly reduced and the extension of the mounting end of the neck further reduced the resonance chamber and subdivides the interior of the chamber thereby having significant impact on the overall sound quality of the instrument.

There is therefore a need for a unique guitar construction that enhances the ability of the player to play higher fret positions while maintaining the stability and integrity of the guitar construction and not interfering with the traditional aesthetics and tonality achieved in a guitar by providing a substantially open and unrestricted compartment beneath the sound board.

BRIEF SUMMARY OF THE INVENTION

In this regard, the present invention provides a novel guitar configuration that has improved playability without requiring a raised fret or fingerboards or a neck that extends through the resonance chamber all the way to the sound hole. The particular construction of the present invention allows the player to play notes in higher fret positions without changing the position of the fretting hand. In this manner, the present invention provides a guitar that is easier to play and results in a guitar that is aesthetically pleasing as compared to prior art solutions.

The present invention generally includes a guitar that has a base portion, wherein the base portion includes a bottom wall, a side wall connected substantially perpendicularly to the bottom wall and a soundboard connected to the side wall opposite the bottom wall. A neck portion is connected to the base portion and is attached to the sidewall. The soundboard defines a substantially planar portion and a curved portion, wherein the curved portion is generally located in the area extending between the sound hole and the neck end of the soundboard with a further edge defined by a line extending from the neck to the sound hole.

In general, as discussed above, the present invention offsets the twelfth fret from the traditional position of the intersection of the neck with the body. The curved portion of the soundboard is bent into a shape that allows the curved surface to join the sidewall of the guitar body preferably, but not limited to, approximately one inch below the base of the neck to create the desired offset. The curve or bend on the surface of the soundboard starts generally around the center of the sound hole and continues to the neck end of the soundboard. The curve or bend may be a straight taper or any other shape desired to achieve the desired effect. The curve provides additional clearance for the fretting hand when playing notes above the ninth fret position.

In the present invention, the guitarist's hand position remains unchanged while playing positions up to the eleventh fret. As can be seen additional clearance between the base of the fret board and the surface of the soundboard is created by the curved portion of the soundboard that allows room for the base of the hand. This additional room also minimizes the hand and arm position changes required for playing positions beyond the eleventh position up to the last fret position. The present invention therefore results in easier access to the notes that are located above the higher positions on the fret board and less work for the player. As a result, playability of the guitar of the present is also improved.

Accordingly, one of the objects of the present invention is the provision of a guitar that facilitates the guitarist playing notes in the higher fret positions. Another object of the present invention is the provision of a guitar that is particularly configured to provide additional space for a guitarist's hand when playing notes in the higher fret positions. A further object of the present invention is the provision of a guitar that has a partially tapered soundboard to provide additional space for the guitarist's hand while maintaining an open sound chamber with minimal obstructions. Yet a further object of the present invention is the provision of a guitar that provides enhanced playability of the higher fret positions while maintaining a high level of resonance and tonality.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
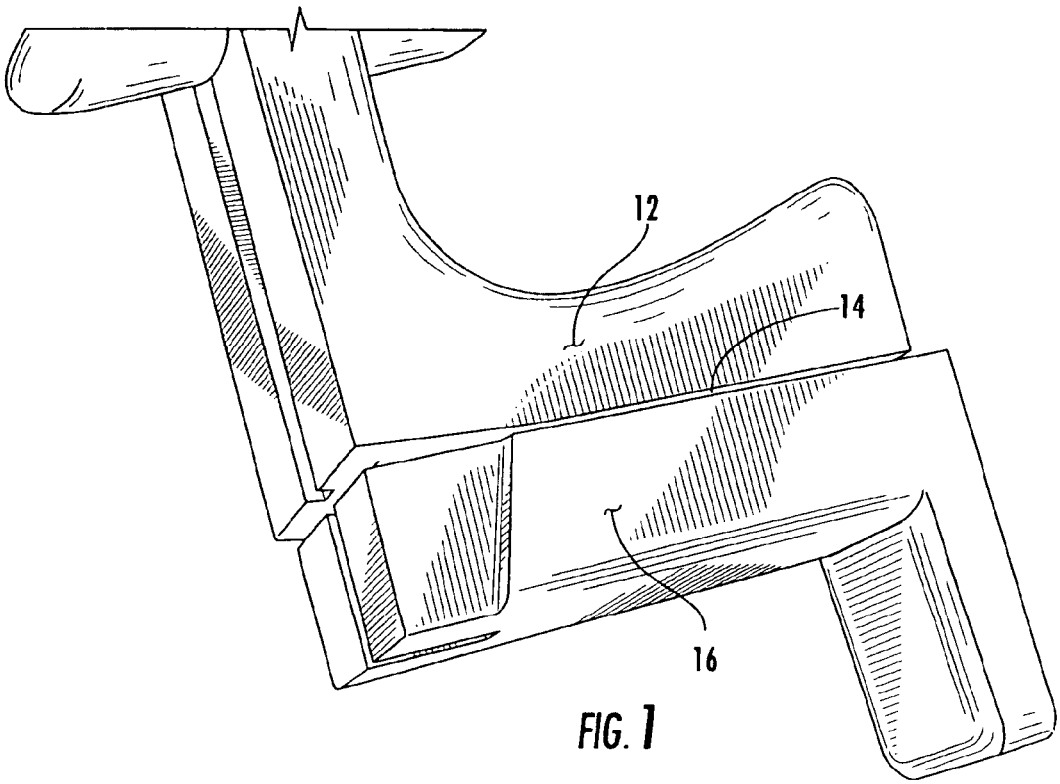
FIG. 1 is a side view of a neck base for the guitar of the present invention with a joint prepared to accept a sidewall and a bent portion of a soundboard.
Figure 7:
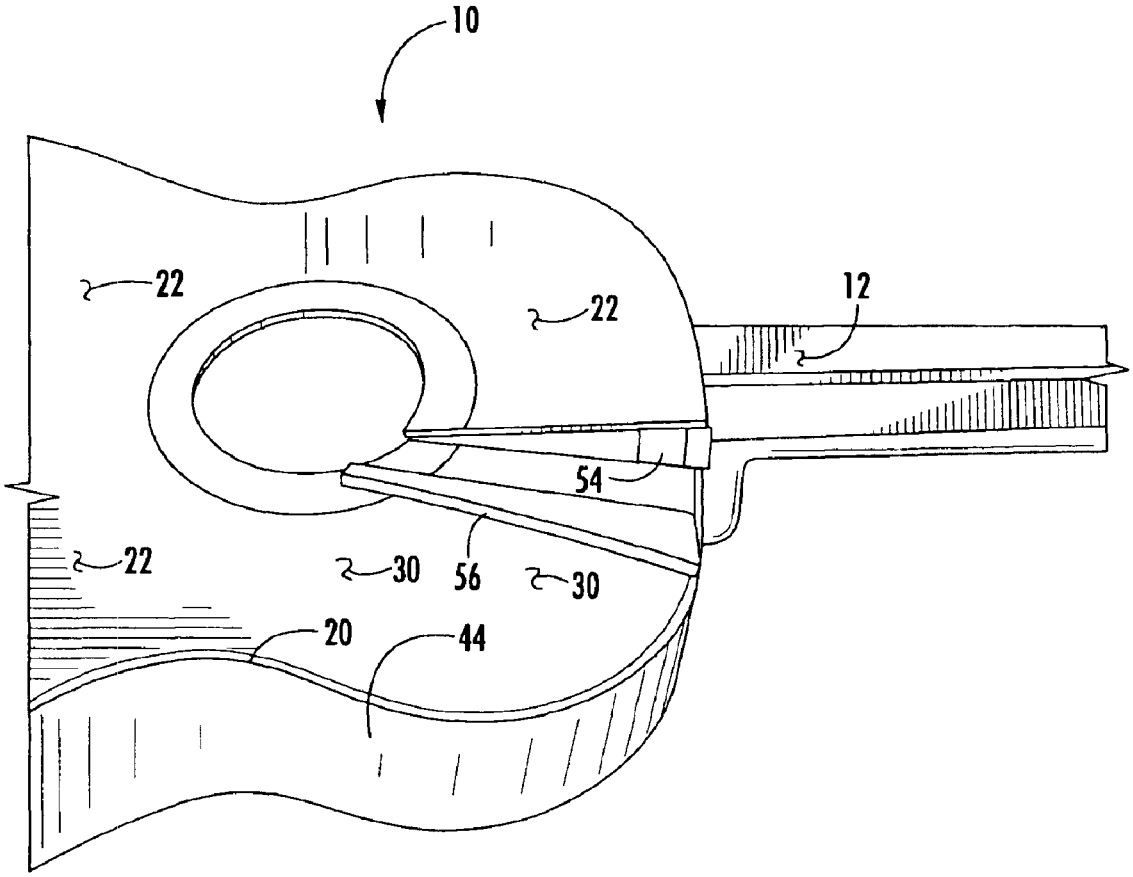
FIG. 7 is a top perspective view of the soundboard, sidewall, and neck block shown in FIGS. 5–6, with a neck attached to the neck block and a bottom wall attached to the sidewall.
Figure 8:
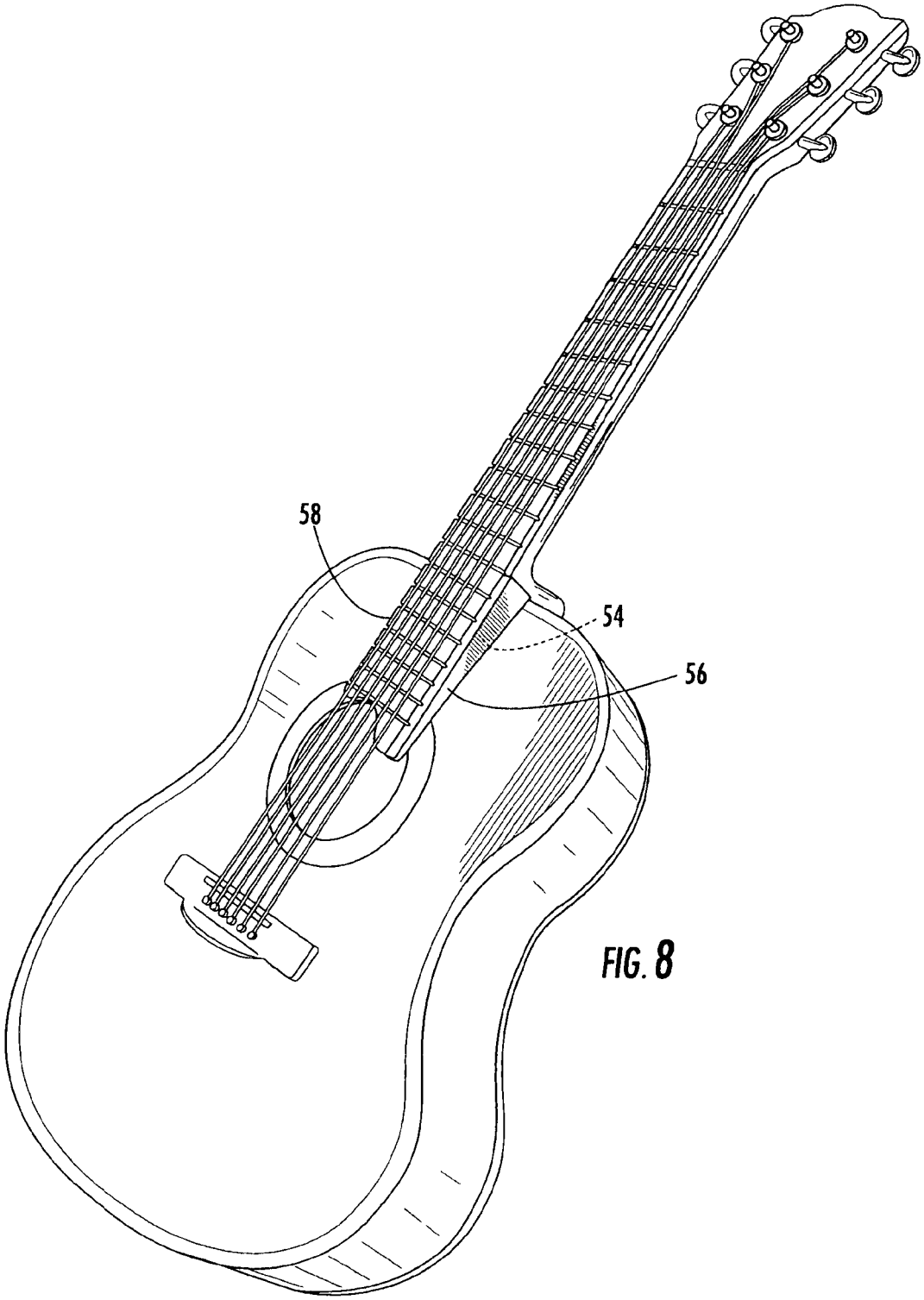
FIG. 8 is a top perspective view similar to FIG. 7, with a fret board overlaid on the neck and soundboard and a spacer wedge is installed on the soundboard.
Figure 9:
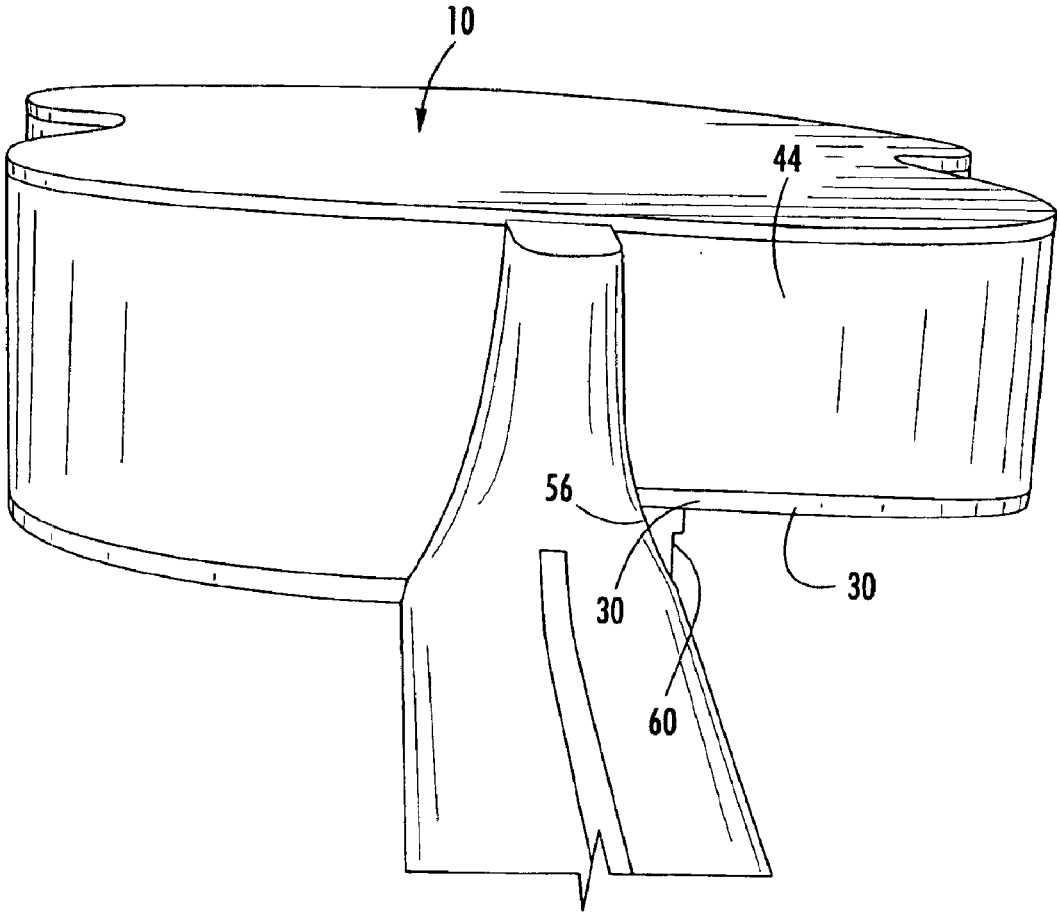
FIG. 9 is a bottom end view of a guitar according to the present invention.

Referring now to the drawings, the preferred embodiment of a guitar 10 according to the present invention is generally shown and illustrated in FIGS. 1–9, with a completed instrument illustrated best in FIGS. 8 and 9. It should be noted that while a right-handed instrument is shown, the teachings of the present invention could be equally adapted for left-handed use. Generally, the guitar 10 of the present invention includes a neck 12 and a body (discussed in detail below). One type of suitable neck 12 is best shown in FIG. 1 and is generally well known in the art. The neck 12 is mated with a neck base 16 and is generally formed in one structure. The neck base 16 is generally mounted into the body of the guitar 10 and is configured to receive the end of the neck 12 and support it in a rigidly mated position relative to the body of the guitar. Further, the neck 12 and neck base 16 may be made in two pieces and joined in any required configuration using techniques that are well known in the art. The neck 12 may include a joint 14 at the location where it contacts the neck base 16, where the joint 14 configured to accept and retain a free end of the side wall of the body and support the particular soundboard configuration of the present invention as will be described in detail below.

Figure 2:
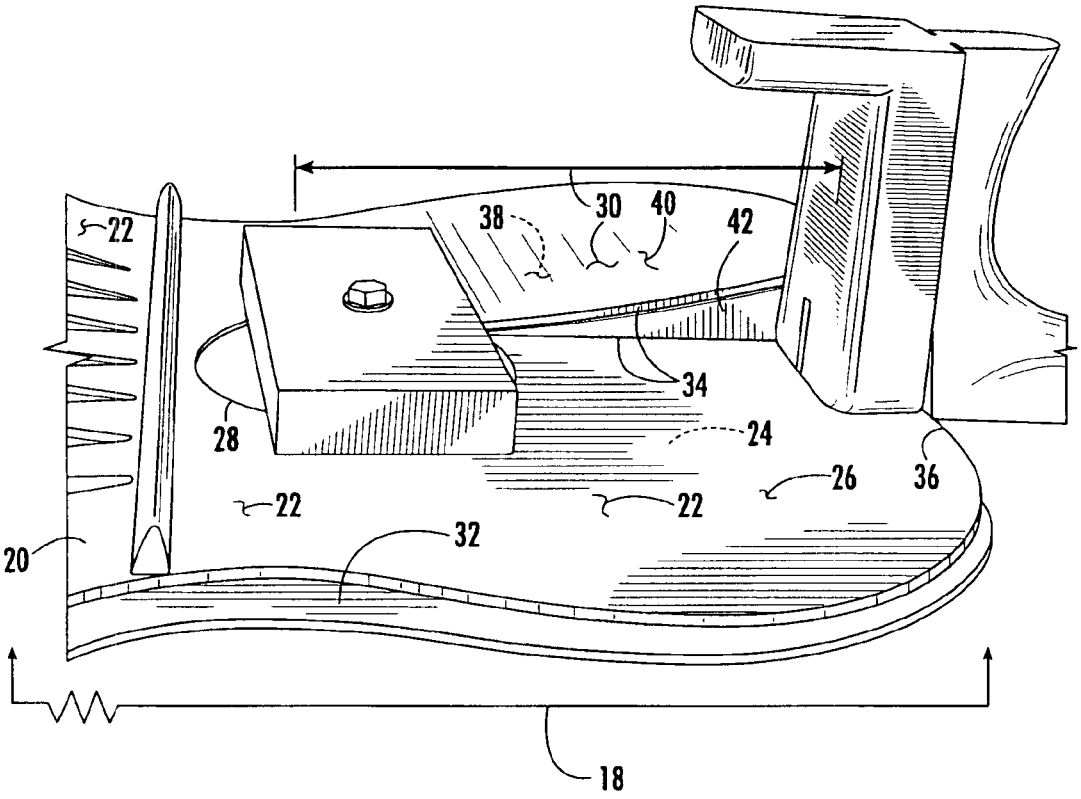
FIG. 2 is an interior perspective view of the back of the guitar soundboard of the present invention with the neck base connected thereto.
Figure 3:
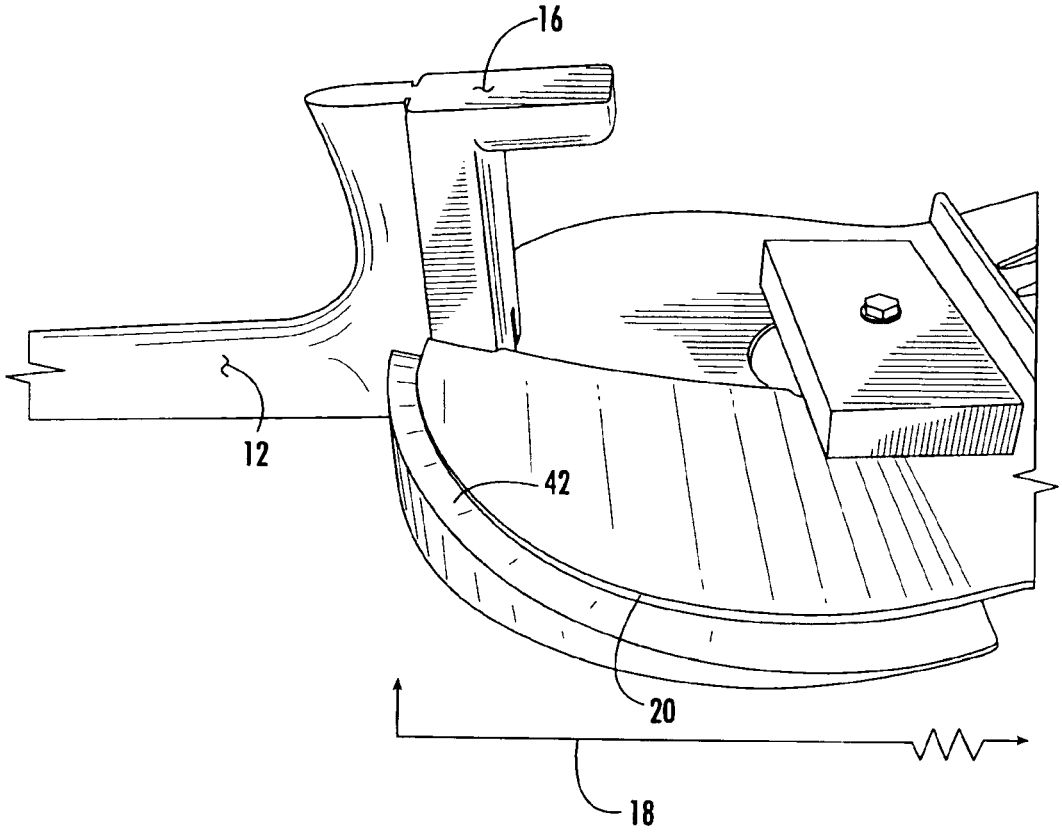
FIG. 3 is a perspective opposite view of the soundboard shown in FIG. 2.

As is best shown in FIG. 2, the body portion 18 of the guitar 10 generally includes a soundboard 20 that defines a substantially planar surface 22 having an exterior surface 24 and an interior surface 26. A sound hole 28 is provided that extends through the soundboard 20. Further, the novel feature of the present invention is that the soundboard 20 is provided with a curved surface 30 (labeled generally and specifically). One method of construction that may be utilized to form the soundboard 20 in the shape disclosed in the present invention provides for clamping the soundboard 20 to a support surface 32 with an exterior side 24 of the planar surface 22 facing the table support surface 32. A slit 34 is made from a neck end 36 of the soundboard 20 to the sound hole 28. One portion of the soundboard 20 positioned adjacent to the slit 34 is then clamped so that it remains coplanar with the remainder of the substantially planar surface 22. The other portion of the soundboard 20 adjacent to the slit 34 is bent inwardly toward the interior 26 of the substantially planar surface 22, to form the curved surface 30 that defines an outer curved surface 38 and an inner curved surface 40. The curved surface 30 can be maintained in its formed position by inserting a wedge 42 between the support surface 32 and the outer curved surface 38 of the soundboard 20 and heating the soundboard 20. It can be appreciated that the soundboard 20 can be bent before mounting on the support surface 32. Further, as shown in FIGS. 3 and 4, the neck 12 and neck base 16 shown and described in FIG. 1 can be installed into an operative position relative to the soundboard 20.

Figure 4:
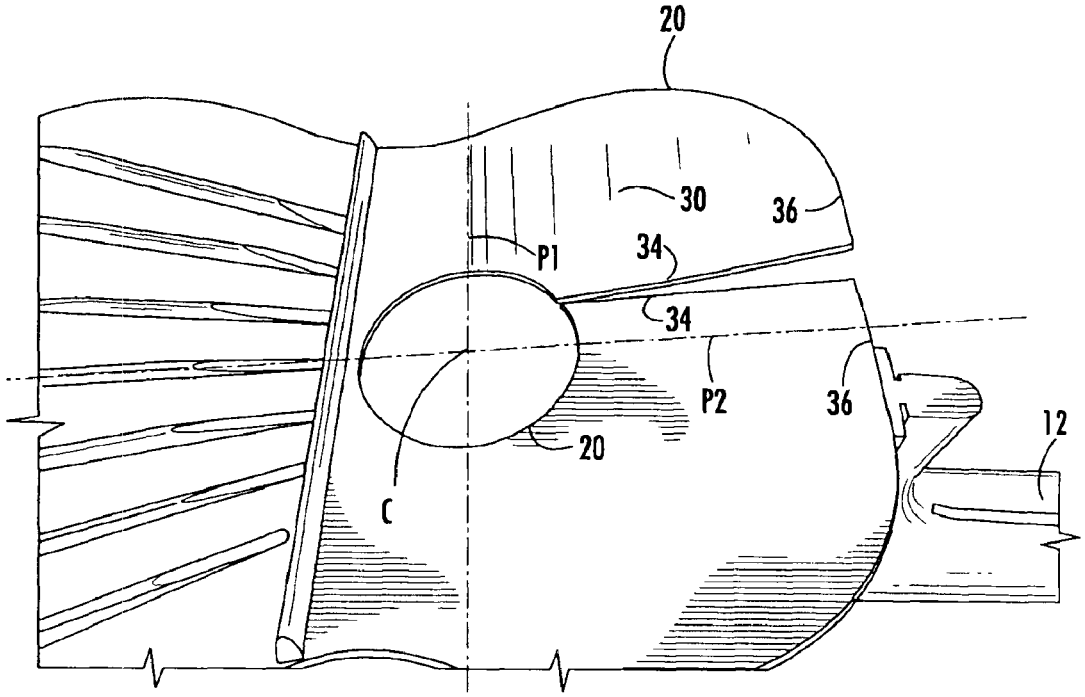
FIG. 4 is a perspective view of the soundboard shown in FIG. 2 with the neck base removed.

FIG. 4 shows that the curved surface 30 of the soundboard 20 begins at an imaginary axis defined as P1, which extends linearly from an approximate the center C of the sound hole 28 and continues to the neck edge 36 of the soundboard 20. It should also be noted that the slit 34 is positioned on one side of the neck 12, so the curved surface 30 preferably does not touch or cross an imaginary longitudinally extending center axis P2 passing through a longitudinal length of the guitar and perpendicularly intersecting the imaginary axis P1 at the center C of the sound hole 28. The position of the slit 34 and the origin axis P1 for the curved surface 30 can be modified or moved while still remaining within the scope of the present invention, however, the locations described above have been found to produce the best acoustical values and provide an aesthetic, visually pleasing instrument.

With continuing reference to FIGS. 1 and 4, FIGS. 5 and 6 show side walls 44 installed onto the soundboard 20. The neck base 16 is also shown mounted to the soundboard 20 with the side walls attach 44 attached thereto. Further, the neck 12 is attached to the neck base 16. As can be seen, once assembled in this manner, the ends of sidewall 44 are captured between the neck base 16 and the neck 12 and are attached thereto via the joint 14.

Figure 5:
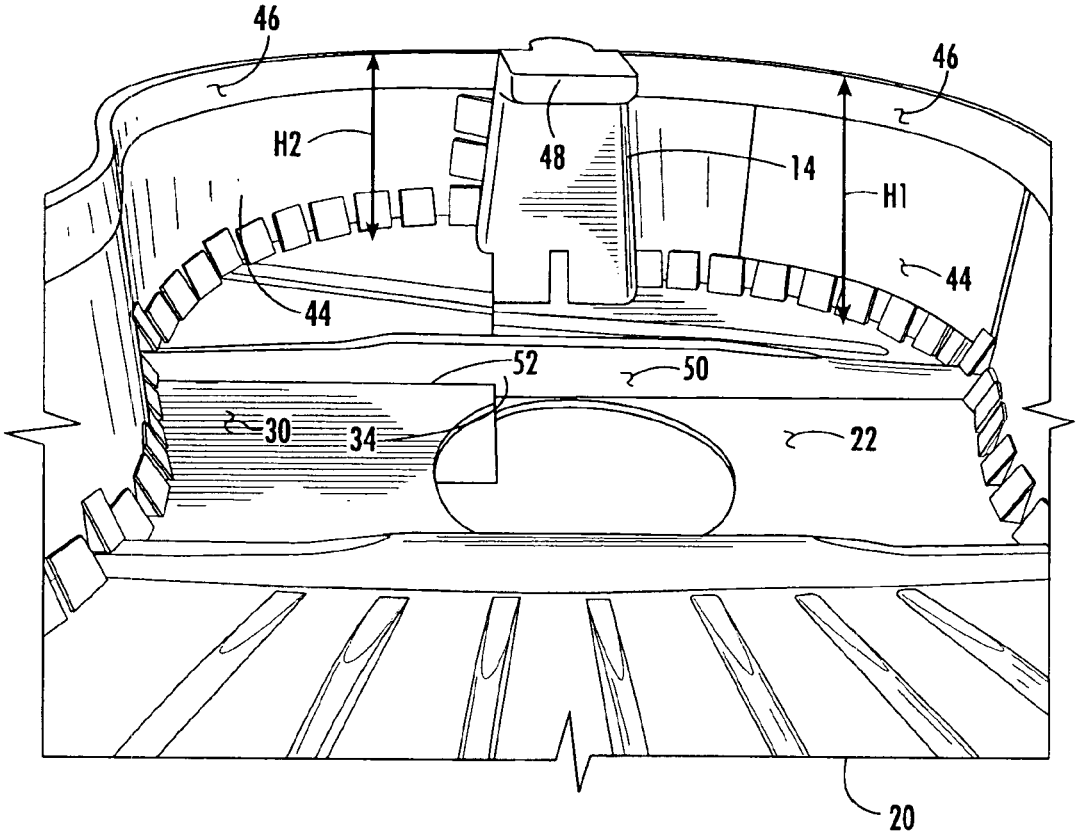
FIG. 5 is perspective end view of the soundboard shown generally in FIGS. 2–4 with a sidewall and neck block installed.
Figure 6:
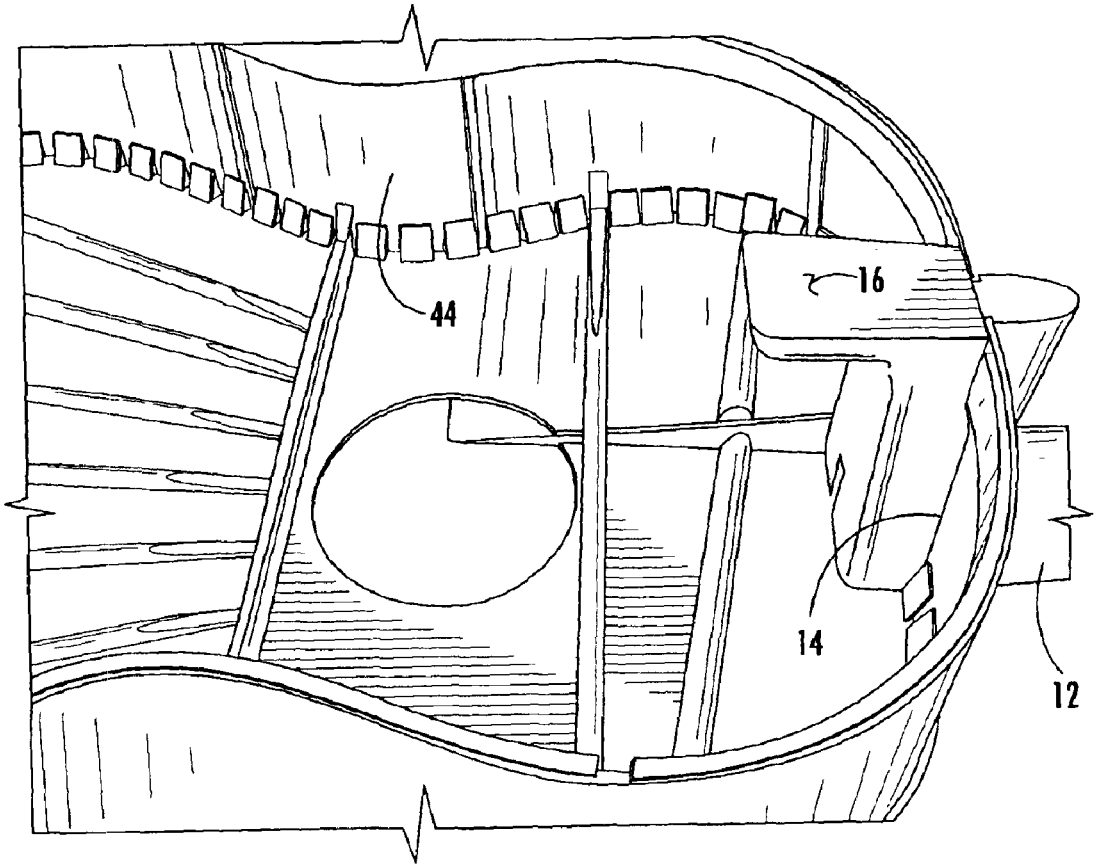
FIG. 6 is the perspective end view shown in FIG. 5 rotated ninety degrees.

As can be best seen in FIG. 5, the sidewall 44 does not have a uniform height around the entire perimeter of the soundboard 20. In this view, H1 is larger than H2. In order to facilitate the formation of the curved surface 30 of the soundboard 20, the sidewall 44 decreases in overall height H2 where it contacts the soundboard 20 in the area adjacent to the curved surface 30. The top edge of the remaining side wall 44 extending from the line P1 back around towards the neck 12 to slit 34 are all maintained substantially co-planar. Further, the entire opposite edge 46 of the sidewall 44 and a support surface 48 of the neck base 16 are all maintained in a co-planar relation. This configuration allows a substantially planar base (not shown) to be attached to the edge 46 of the entire side wall 44 and the support surface 48 of the neck base 16 thereby providing closure for the back of the guitar 10. Note also the support strut 50 that crosses over the substantially planar surface 22 of the soundboard 20, the slit 34, and the curved surface 30 is notched 52 to accommodate the curved surface 30. The positions and configuration used to place the support struts 50 within the guitar 10 can be modified in location and design and remain within the scope of the present invention.

FIG. 7 shows the soundboard 20, the sidewall 44, and the neck 12 of the guitar 10 in assembled relation. The curved surface 30 of the soundboard 20 can be seen to deflect below the substantially planar surface 22 of the soundboard 20 in tapered relation thereto, with a wedge shaped gap 54 defined between the substantially planar surface 22 and curved surface 30 of the soundboard 20. The gap 54 is filled by a wedge 56 to provide closure for the interior of the guitar 10 forming a resonance chamber therein.

FIG. 8 shows the wedge 56 inserted into the gap 54 and a fret board 58 installed over the top surface of the neck 12 and soundboard 20. It is noted that while the fret board 58 overlays the soundboard 20, the neck 12 stops at the side wall 44 (except for the neck base which is concealed within the side wall, the sound board, and the base) and does not extend to the interior of the guitar 10, thereby leaving the resonance chamber clear. By assembling the guitar 10 in accordance with the present invention, it is clear that the structural integrity of the guitar 10 is maintained without requiring that the neck 12 extend into the body portion 18 thereby occupying space within the resonance chamber.

FIG. 9 shows a neck end view of the guitar 10 according to the present invention. As can be illustrated most dramatically by this view, the height of sidewall 44 is shown smaller in the area adjacent the curved surface 30 of the soundboard 20 and a lip 60 is defined where the wedge 56 is installed.

It can therefore be seen that the present invention provides an improved guitar 10 that has improved playability for a guitarist playing positions starting above the ninth fret. Further, the guitar 10 of the present invention achieves this improvement while maintaining its structural integrity and maintaining the sound quality by not reducing the interior resonance chamber of the guitar 10. Further, the structure of the present invention can be modified for incorporation into a number of variations of stringed instruments, including both fretted and non-fretted instruments, to create a useful and more easily played instrument while maintaining a high quality of sound. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A body for a stringed instrument comprising:

a bottom wall having a peripheral edge;

a sidewall having a top edge, said sidewall extending upwardly from said peripheral edge of said bottom wall;

means for fastening a string support to said body, said means provided in said sidewall;

a substantially planar soundboard having a peripheral edge, a length, a width, a longitudinal axis extending along the length thereof and a lateral axis extending along the width thereof, said peripheral edge of said soundboard interconnected to said top edge of said sidewall wherein said bottom wall, said side wall and said soundboard cooperating to form a sound chamber therebetween, a portion of said sound board bounded by said longitudinal axis, said lateral axis and said peripheral edge being deflected relative to the plane of said soundboard downwardly toward said bottom wall.

2. The body for a stringed instrument of claim 1 wherein said soundboard is cut along a portion of said longitudinal axis allowing said deflected portion of said soundboard to be deflected in a single direction relative to said plane of said sound board.

3. The body for a stringed instrument of claim 2 wherein said deflected portion of said sound board is flat and resides in a plane that is inclined relative to said plane of said soundboard.

4. The body for a stringed instrument of claim 2 wherein said deflected portion of said sound board is curved relative to said plane of said soundboard.

5. The body for a stringed instrument of claim 2, further comprising:

an elongated neck having an upper surface, a first end connected to said means for fastening a string support and a second free end, said neck being substantially parallel to said longitudinal axis, said longitudinal axis being adjacent one side of said neck;

a fret board on said upper surface of said neck, a portion of said fret board extending over said soundboard;

means on the free end of the neck for holding one end of each of a plurality of strings; and means for securing the other end of said plurality of strings to the body, said strings extending in spaced relation above said fingerboard and said soundboard.

6. The body for a stringed instrument of claim 1 wherein said soundboard further includes a sound hole therein said sound hole having a center, said longitudinal axis and said lateral axis extending through said center.

7. The body for a stringed instrument of claim 1, further comprising:

an elongated neck having an upper surface, a first end connected to said means for fastening a string support and a second free end, said neck being substantially parallel to said longitudinal axis, said longitudinal axis being adjacent one side of said neck;

a fret board on said upper surface of said neck, a portion of said fret board extending over said soundboard;

means on the free end of the neck for holding one end of each of a plurality of strings; and means for securing the other end of the plurality of strings to the body, said strings extending in spaced relation above said fingerboard and said soundboard.

8. A guitar comprising:

a body having a soundboard and a bottom wall, said soundboard and said bottom wall interconnected in spaced relation by a sidewall, said sound board being substantially planar and having a peripheral edge, a length, a width, a longitudinal axis extending along the length thereof and a lateral axis extending along the width thereof;

an elongated neck having an upper surface, a first end portion connected to said sidewall of said body and a second free end, one side of said neck and said longitudinal axis being substantially aligned, wherein a portion of said sound board bounded by said longitudinal axis, said lateral axis and said peripheral edge being deflected relative to the plane of said soundboard downwardly toward said bottom wall;

a fret board fixed to the upper surface of said neck wherein a portion of said fret board extends over said soundboard;

means on the free end of the neck for holding one end of each of a plurality of strings; and means for securing the other end of said plurality of strings to the body so that said strings extend in spaced relation over said fret board and said soundboard.

9. The guitar of claim 8 wherein said soundboard is cut along a portion of said longitudinal axis allowing said deflected portion of said soundboard to be deflected in a single direction relative to said plane of said sound board.

10. The guitar of claim 9 wherein said deflected portion of said sound board is flat and resides in a plane that is inclined relative to said plane of said soundboard.

11. The guitar of claim 9 wherein said deflected portion of said sound board is curved relative to said plane of said soundboard.

12. A method of manufacturing a body for a stringed instrument comprising the steps of:

providing a substantially planar soundboard substrate, said substrate having a peripheral edge, a length, a width, a longitudinal axis extending along the length thereof and a lateral axis extending along the width thereof;

cutting said substrate along a portion of said longitudinal axis;

deflecting a portion of said soundboard defined by said cut portion of said longitudinal axis, said lateral axis and said peripheral edge relative to the plane of said soundboard;

installing a sidewall extending upwardly from said peripheral edge of said soundboard, said side wall having a free edge, said sidewall including means for installing a string support; and installing a back wall onto said free edge of said sidewall, said soundboard, said sidewall and said back wall defining a hollow interior chamber.

13. The method of manufacturing a body for a stringed instrument of claim 12 wherein said deflected portion of said sound board is flat and resides in a plane that is inclined relative to said plane of said soundboard.

14. The method of manufacturing a body for a stringed instrument of claim 12 wherein said deflected portion of said sound board is curved relative to said plane of said soundboard.

15. The method of manufacturing a body for a stringed instrument of claim 12, further comprising the steps of:

attaching an elongated neck to said means for installing a string support, said neck having an upper surface, a first end connected to said means for fastening a string support and a second free end, said neck being substantially parallel to said longitudinal axis, said longitudinal axis being adjacent one side of said neck; and installing a fret board on said upper surface of said neck, a portion of said fret board extending over said soundboard, said free end of said neck including means for holding one end of each of a plurality of strings, said body including means for securing the other end of the plurality of strings to the body, said strings extending in spaced relation above said fingerboard and said soundboard.

* * * * *